US006158181A

United States Patent [19]

Musgrave et al.

[11] Patent Number: 6,158,181

[45] Date of Patent: Dec. 12, 2000

[54] ROOFING STRUCTURES

[76] Inventors: Paul Barnaby Musgrave, 35 Winchester Road, Eastleigh, Hampshire, United Kingdom, SO35 2GF; Anthony Squibb, 39 Cordelia Close, Hythe, Hampshire, United Kingdom, SO45 5UD

[21] Appl. No.: 09/217,148

[22] Filed: Dec. 21, 1998

[30] Foreign Application Priority Data

| | | | |
|---|---|---|---|
| Dec. 19, 1997 | [GB] | United Kingdom | 9726948 |
| Sep. 4, 1998 | [GB] | United Kingdom | 9819412 |

[51] Int. Cl.[7] ..... E04B 1/00

[52] U.S. Cl. ..... 52/222; 52/23; 182/129

[58] Field of Search ..... 52/222, 23; 182/129

[56] References Cited

U.S. PATENT DOCUMENTS

| | | | |
|---|---|---|---|
| 3,186,129 | 6/1965 | Blood | 52/222 |
| 3,355,851 | 12/1967 | Imbertson et al. | 52/222 |
| 3,791,077 | 2/1974 | Ventimiglia | 52/222 |
| 3,844,080 | 10/1974 | Brock et al. | 52/222 |
| 3,995,715 | 12/1976 | Virtanen | 182/129 |
| 4,189,882 | 2/1980 | Harrison et al. | 52/222 |
| 4,473,982 | 10/1984 | Monari | 52/222 |
| 4,485,599 | 12/1984 | Perradin | 52/222 |
| 4,534,145 | 8/1985 | Yang et al. | 52/222 |
| 4,711,060 | 12/1987 | Scherrer | 52/222 |
| 4,805,735 | 2/1989 | Anderson | 182/129 |
| 6,029,556 | 2/2000 | Rexroad | 182/129 |

FOREIGN PATENT DOCUMENTS

| | | |
|---|---|---|
| 207 008 | 12/1986 | European Pat. Off. . |
| 2 254 879 | 10/1992 | United Kingdom . |

*Primary Examiner*—Beth A. Stephen
*Assistant Examiner*—Dennis L. Dorsey
*Attorney, Agent, or Firm*—Kilpatrick Stockton LLP

[57] ABSTRACT

A roofing structure assembly comprises elongate roofing material support members including means for attachment to roofing scaffold members and a flexible roofing material engageable with said support members, in which the support members include means for tensioning the roofing material between adjacent support members in use.

The roofing material is preferably supported above the scaffold members and is tensioned by applying invented channel section capping members over the support members to apply out-of-plane deformation to the roofing material.

10 Claims, 3 Drawing Sheets

ROOFING STRUCTURES

This invention relates to roofing or containment structures especially of the type for providing a weatherproof membrane over large areas.

FIELD OF THE INVENTION

It is known to provide temporary shelters or relocatable buildings with roofing or containment structures in which the roof may be supported only at the eaves, or may be supported additionally by internal pillars. In both embodiments a flexible waterproof covering or membrane is fastened to the roofing beams. However, the fastening is achieved by means of straps or ties or by staple, nail or screw, and tension is applied through adjustment of the strap or tie or through screwing down an inverted channel-section beam to a component to which the membrane is attached and which is an integral part of the structural bracing system.

It is an object of the present invention to provide a roofing structure in which a range of scaffolding sheeting materials may be located, held in position and quickly tensioned on any existing standard scaffold or structure, whether propriety or not, without interfering with the other functions of the structure.

SUMMARY OF INVENTION

According to one aspect of the invention, a roofing structure assembly comprises elongate roofing material support members including means for attachment to roofing scaffold members and a flexible roofing material engageable with said support members, in which the support members include means for tensioning the roofing material between adjacent support members in use.

The attachment means of the support members may comprise spacer posts or brackets secured to the underside of the support members, for example by welding or by bolts, terminating at their lower ends in scaffolding clamps for attachment to roofing scaffold members at any desired location. The support members are thereby carried above and spaced apart from the scaffold members, thereby allowing conventional scaffold fittings and tubing to be fitted to the scaffold members without interference. As an alternative to scaffolding clamps for securing the spacer posts, brackets or other means for attachment of the roofing material support members to the scaffold members, the lower end of the attachment means may comprise limbs which straddle the scaffold members and can be locked thereto for example by lock means comprising a pin or stud which passes through holes formed in the limbs and a corresponding lateral hole formed in the scaffold member. The lock means may include means to retain it in place in the locked position; such retainer means may comprise a quick-release resilient wire retaining element. The tensioning means may comprise elongate capping members attachable over the support members to clamp the roofing material and to apply lateral tension thereto between adjacent elongate support members.

Preferably, the support members are maintained spaced apart from the scaffold members to which they are attached and above the plane containing the roofing material, and the capping members act to tension the roofing material by applying out-of-plane deformation thereto, for example by causing it to deform outwardly over the support members, whereby the roofing material is tensioned between adjacent capping members. The capping members are preferably of channel-section configuration and are applied inverted over the elongate roofing material support members, whereby the walls of the channel-section member cause the roofing material to bend or fold out of and below the plane of the support members and thereby to take up lateral slack in the roofing material between the support members. The support members are preferably provided with upstanding stud members over which the roofing material is located and by virtue of which the capping members may be secured to the support members, clamping the roofing material therebetween. The stud members are preferably removable from the support members to allow for replacement thereof. In one embodiment, the stud members comprise bolts which also function to secure the roofing material support members to the attachment means.

The roofing material may be provided in strip or sheet form with pre-formed holes for receiving the stud members. Preferably, the holes are formed in longitudinal edge regions of the strips, the edge regions being reinforced to enhance the strength thereof. The lateral spacing between adjacent members as attached to the scaffold members via the support posts should be somewhat less than the lateral spacing between the holes in the respective edge regions of the roofing material, whereby the roofing material is applied untensioned to the support members and is subsequently tensioned by application of the capping members.

Embodiments of the invention will now be described by way of example with reference to the accompanying drawings, of which:

DETAILED DESCRIPTION OF INVENTION

Figure 1:
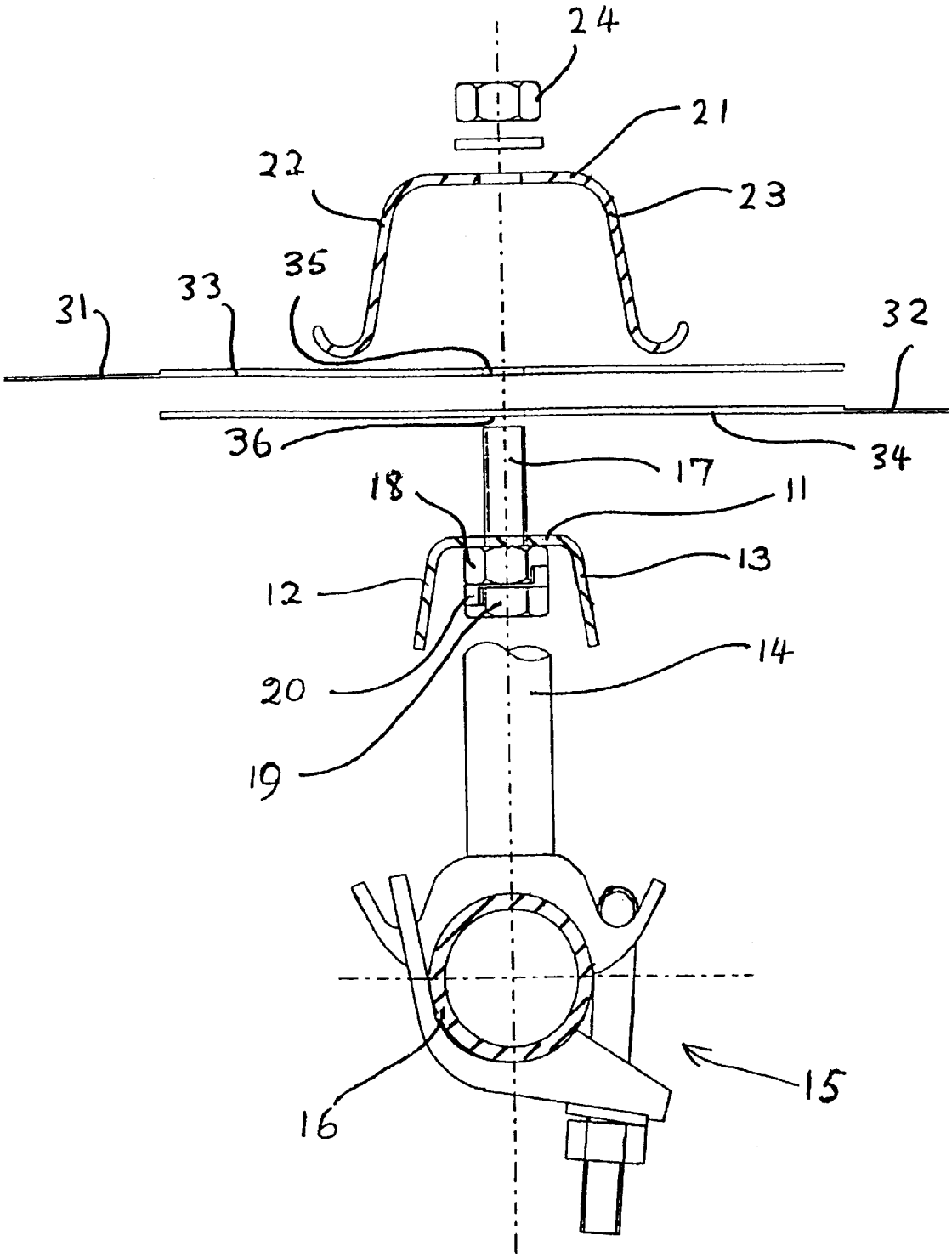
FIG. 1 shows an exploded view of the components of one embodiment of a roofing structure assembly according to the invention.

Referring firstly to FIG. 1, an elongate support member 11 is formed in a channel section with wings 12, 13 joined by a central web. Spacer posts 14 are welded to the underside of the central web to depend therefrom at longitudinally spaced apart locations; the spacer posts 14 carry scaffold clamps 15 at their lower ends for attachment in known manner to a horizontal scaffold pole 16 forming part of a roof support frame structure. At intermediate longitudinal spaced apart locations, the support member 11 is provided with upstanding threaded studs 17 received in a threaded nut 18 welded to the underside of the web of the support member 11 and secured thereto with a locknut 19 and tab washer 20. The upper end of the spacer post 14 is shown broken away to reveal the nut 18, locknut 19 and tab washer 20 behind it. A capping member 21 is also formed in a channel section with holes to receive the studs 17; the sides 22, 23 of the capping member are adapted such that there is lateral clearance between the respective sides and wings 12, 13 of the support member when the capping member is located over the support member. The lower edges of the sides 22, 23 of the capping member are upturned outwardly. The capping member is secured in place on each support stud by nut 24.

Sheets of polyethylene roofing material 31, 32 are provided with reinforced edge regions 33, 34 with holes 35, 36 formed therein. The holes are dimensioned to receive the threaded studs 17 attached to the support member 11.

Figure 2:
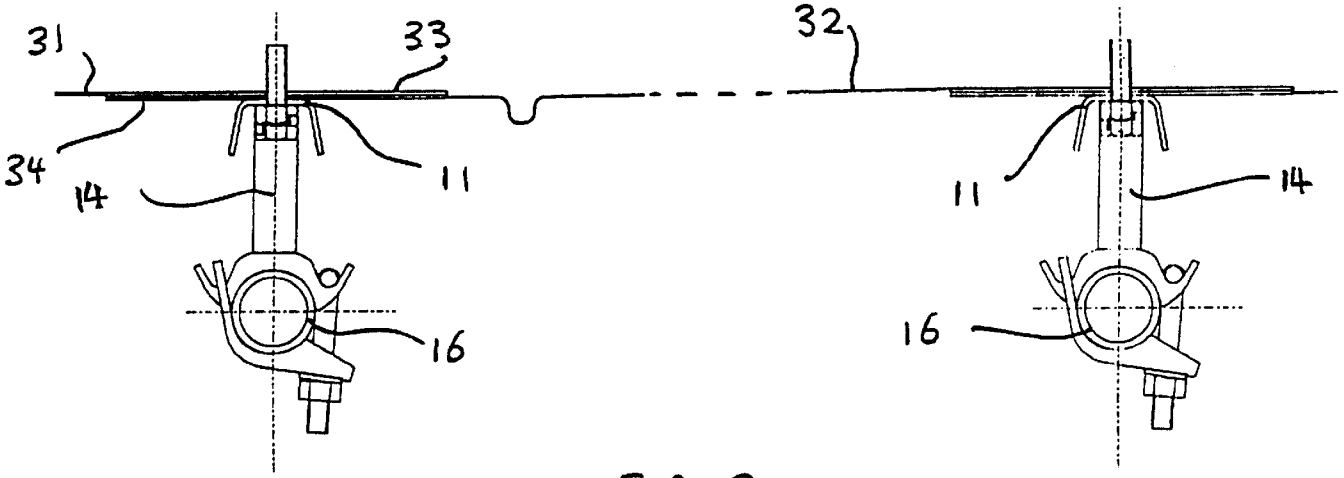
FIG. 2 shows an initial stage in the application of the roofing structure shown in FIG. 1 to adjacent scaffold members of a shelter.
Figure 3:
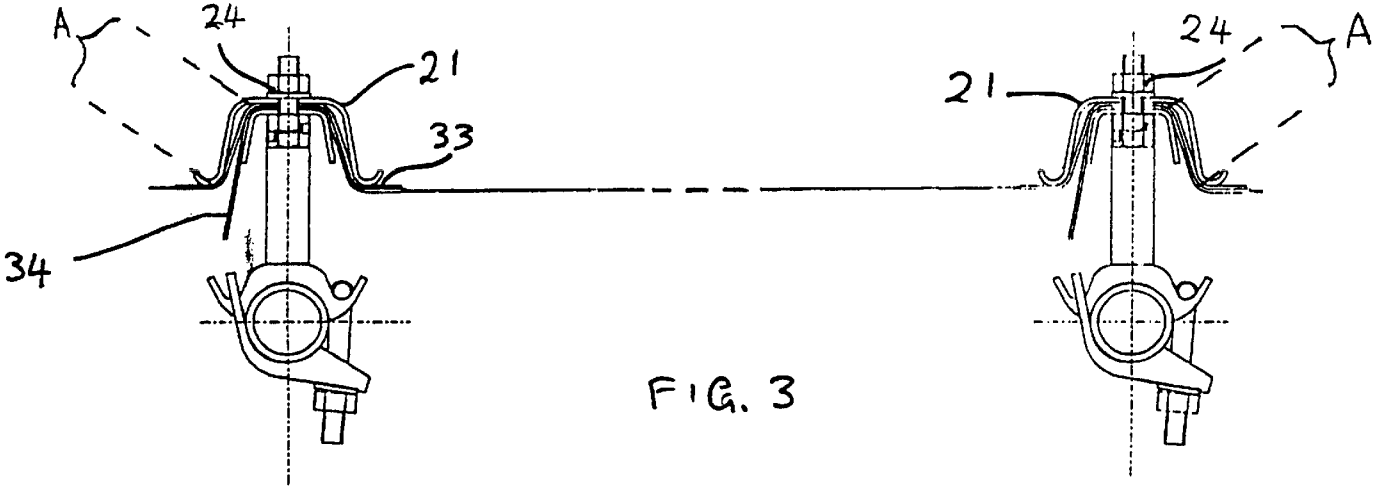
FIG. 3 shows the completed roofing structure of FIG. 2.

In use and with reference to FIG. 2, support members 11 are clamped to scaffold tubing 16 via the spacer posts 14 and clamps 15, adjacent scaffold tubes 16 having a lateral spacing or pitch slightly less than the lateral spacing between corresponding holes in respective regions of a sheet. Roofing sheets are then applied to the support members 11 and engaged with the studs 17, with edge regions of adjacent sheets overlapping, slate-fashion, to prevent ingress of rainwater. Because the lateral spacing between corresponding holes in each sheet is greater than the pitch of the support members, the roofing sheets do not require to be tensioned in order to apply the second edge holes over the studs, having previously applied the first edge holes. Capping members 21 are then applied and secured with nuts 24, to clamp the roofing sheets to the support members. As shown in FIG. 3, the sides of the capping members have the effect of folding or bending the edge regions of the roofing sheets, immediately inwardly of and around the shoulders of the support members 11, to tension the roofing material between adjacent lower edges of respective capping members 21, the out-of-plane parts indicated A effectively taking up the lateral slack between adjacent support members.

A damaged stud 17 may be replaced by bending the tabs of the tab washer 20 out of engagement with locknut 19, removing the locknut, unscrewing the stud and inserting and securing a new stud by the reverse process.

Figure 4:
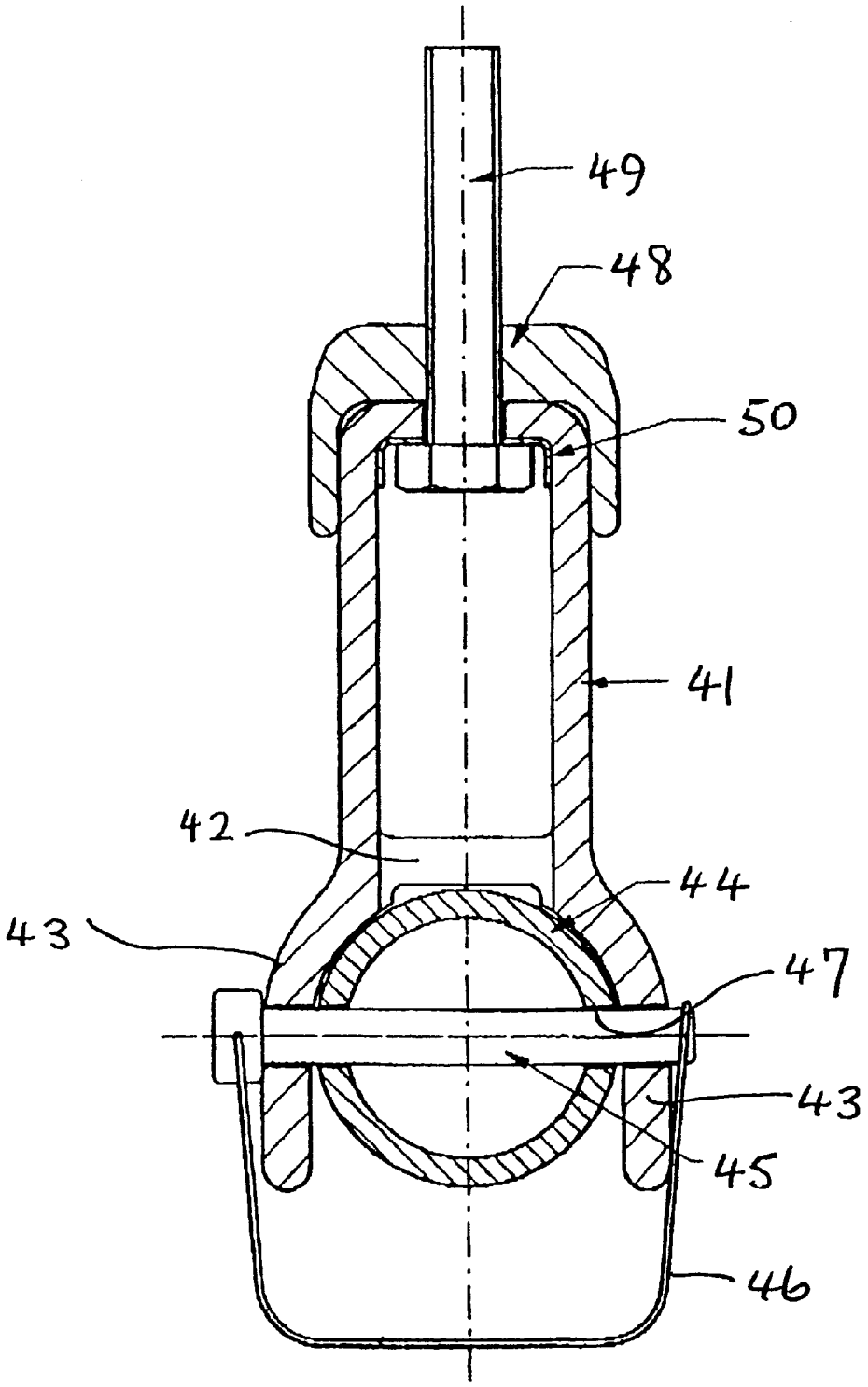
FIG. 4 shows another embodiment of a roofing structure assembly according to the invention.

Referring to FIG. 4, a spacer support bracket 41 formed as an inverted U-shaped aluminium extrusion with a cross-brace member 42 has lower arms 43 which are dimensioned to fit over and on each side of a scaffold pole 44. A snapper pin 45 with a resilient wire retainer 46 is passed through coaxial holes in the respective arms 43 and through a selected one of a series of holes 47 formed laterally through the scaffold tube to secure the bracket 41 in position. An inverted-U strip support member 48 is placed over the bracket and over the neighbouring brackets secured, spaced apart, to the scaffold tube, for supporting roofing sheets in like manner to the arrangement as shown in FIGS. 1 to 3, with similar capping members (not shown). A threaded set bolt 49 is retained by tab washer 50 through holes formed in the bridge of U-bracket 41 and in the support member 48 and serves for location and attachment of the roofing sheets and capping member, with a washer and bolt as shown in FIGS. 1 to 3.

In the arrangement described with reference to FIG. 4, the bolts 49 are coaxial with the brackets 41 whereas, in the arrangement described with reference to FIGS. 1 to 3, the bolts 17 are disposed between, or at least are separate from along support members 11, the spacer posts 14. However, the arrangement of FIGS. 1 to 3 could be adapted so that bolts 17 and posts 14 are at common locations along support member 11.

What is claimed is:

1. A roofing structure assembly comprising elongate roofing material support members including means for attachment to roofing scaffold members and a flexible roofing material engageable with said support members, in which the support members include means for tensioning the roofing material between adjacent support members in use.

2. A roofing structure according to claim 1, wherein the attachment means of the support members comprise spacer posts secured to the underside of the support members, said spacer posts terminating at their lower ends in scaffolding clamps for attachment to roofing scaffold members at any desired location.

3. A roofing structure according to claim 1, wherein the lower end of the attachment means comprise limbs which straddle the scaffold members in use, said limbs including lock means for locking thereof to the scaffold members.

4. A roofing structure according to claim 3, wherein the lock means comprise a pin or stud which passes through holes formed in the limbs and a corresponding lateral hole formed in the scaffold member.

5. A roofing structure according to claim 1, wherein the tensioning means comprise elongate capping members attachable over the support members to clamp the roofing material and to apply lateral tension thereto between adjacent elongate support members.

6. A roofing structure according to claim 1, wherein the support members are maintained spaced apart from the scaffold members to which they are attached and above the plane which contains the roofing material, the capping members acting to tension the roofing material by applying out-of-plane deformation thereto.

7. A roofing structure according to claim 6, wherein the capping members are of channel-section configuration and are applied inverted over the elongate roofing material support members, whereby the walls of the channel-section member cause the roofing material to bend out of and below the plane of the support members and thereby to take up lateral slack in the roofing material between said support members.

8. A roofing structure according to claim 5, wherein the support members comprise upstanding stud members over which the roofing material is located, said capping members being secured to said support members by said stud members, whereby said roofing material is clamped between said capping members and said support members.

9. A roofing structure according to claim 8, wherein the said stud members are removable from said support members to allow for replacement thereof.

10. A roofing structure according to any preceding claim, wherein the said roofing material is in strip form and has pre-formed holes for receiving the stud members formed in reinforced longitudinal edge regions of the strips.

* * * * *